US006190136B1

(12) United States Patent
Meloche et al.

(10) Patent No.: US 6,190,136 B1
(45) Date of Patent: Feb. 20, 2001

(54) DIAPHRAGM FAILURE SENSING APPARATUS AND DIAPHRAGM PUMPS INCORPORATING SAME

(75) Inventors: Joseph L. Meloche, Royal Oak, MI (US); Kevin C. Stuart, Paulding, OH (US)

(73) Assignee: Ingersoll-Rand Company, Woodcliff Lake, NJ (US)

( * ) Notice: Under 35 U.S.C. 154(b), the term of this patent shall be extended for 0 days.

(21) Appl. No.: 09/385,715

(22) Filed: Aug. 30, 1999

(51) Int. Cl.[7] ..... F04B 49/00; F04B 43/06; G01M 3/04; G01M 3/08

(52) U.S. Cl. ..... 417/63; 417/395; 73/40; 73/46

(58) Field of Search ..... 417/63, 395, 393; 73/40, 46

(56) References Cited

U.S. PATENT DOCUMENTS

| | | | | |
|---|---|---|---|---|
| 2,239,270 | | 4/1941 | Jahreis | 103/25 |
| 2,625,886 | | 1/1953 | Browne | 103/150 |
| 3,131,638 | | 5/1964 | Wilson et al. | 103/44 |
| 3,176,623 | | 4/1965 | Howerton et al. | 103/152 |
| 3,410,263 | | 11/1968 | McGinnis | 128/1 |
| 3,546,691 | | 12/1970 | Smith | 340/242 |
| 3,606,592 | | 9/1971 | Madurski et al. | 417/413 |
| 3,807,906 | | 4/1974 | Breit | 417/383 |
| 4,431,425 | * | 2/1984 | Thompson et al . | 604/246 |
| 4,740,139 | | 4/1988 | Mantell | 417/63 |
| 4,778,356 | | 10/1988 | Hicks | 417/397 |
| 4,787,825 | * | 11/1988 | Mantell | 417/63 |
| 4,854,832 | | 8/1989 | Gardner et al. | 417/393 |
| 4,934,902 | | 6/1990 | Mantell | 417/63 |
| 4,936,753 | | 6/1990 | Kozumplik, Jr. et al. | 417/238 |
| 5,062,770 | * | 11/1991 | Story et al. | 417/46 |
| 5,145,331 | | 9/1992 | Goes et al. | 417/383 |
| 5,188,515 | | 2/1993 | Horn | 417/63 |
| 5,391,060 | | 2/1995 | Kozumplik, Jr. et al. | 417/63 |
| 5,883,299 | * | 3/1999 | Green et al. | 73/40 |
| 6,094,970 | * | 8/2000 | Sprenger et al. | 73/40 |

FOREIGN PATENT DOCUMENTS

WO 95/06205 3/1995 (WO) .

OTHER PUBLICATIONS

Gems®ELS–1100 Series Electro–Optic Level Switch Product Brochure, IMO Industries, Inc., Plainville, Ct., 5 pages.

Warren Rupp Model 032–017–000 SandPiper®Electronic Leak Detector Product Brochure, Sep. 1988, 4 pages.

K.C. Di–Alarm System, Kake–Carter Corp., 2 pages.

Warren Rupp, Inc. SandPiper®Electronic Leak Detector Product Brochure Catalog No. ELD Feb. 1993, 4 pages.

Warren Rupp, Inc., SandPiper®Spill Containment Group Product Brochure (1994), 8 pages.

Proximity Control for Hazardous Locations FYPZ, Micro Switch, a Honeywell division, 1 page.

Pulsefeeder, Inc. Diaphragm Monitor Advertisement, 1 page.

Pulsafeeder—Leak Detection Technology, Catalog 125, Feb. 1989, 6 pages.

Princo®–Princo Instruments, Inc., Bulletin L–11–81,, RF Pipeline Monitors, Nov. 1981, 4 pages.

TraceTek®Systems, Raychem Product Brochure (1985), 10 pages.

* cited by examiner

*Primary Examiner*—Timothy S. Thorpe
*Assistant Examiner*—Michael K. Gray
(74) *Attorney, Agent, or Firm*—Leon Nigohosian, Jr.

(57) ABSTRACT

A diaphragm failure sensing apparatus for use in a diaphragm pump having at least two pumping cavities, each pumping cavity having a fluid chamber and a motive gas chamber separated by a pumping diaphragm. The diaphragm failure sensing apparatus includes a fluid conduit for connection with each of the motive gas chambers of the diaphragm pump, a sensor chamber connected to the fluid conduit, and a check valve located in the fluid conduit for alternately connecting the sensor chamber to the motive gas chambers. Also provided is a diaphragm pump having at least two pumping cavities, each pumping cavity having a fluid chamber and a motive gas chamber separated by a pumping diaphragm. A fluid conduit is disposed between and connected individually to each of the motive gas chambers and a sensor chamber is connected to the fluid conduit which is alternately connected to the motive gas chambers by a check valve located in the fluid conduit.

21 Claims, 3 Drawing Sheets

DIAPHRAGM FAILURE SENSING APPARATUS AND DIAPHRAGM PUMPS INCORPORATING SAME

This invention relates to failure sensors for diaphragm pumps, and more particularly for air operated diaphragm pumps.

Air operated double diaphragm pumps use compressed air to operate diaphragms which alternately draw in and discharge a liquid. Such double diaphragm pumps are known in the art and are widely used in pumping a wide variety of materials. Examples are shown in U.S. Pat. Nos. 4,854,832; 4,936,753; and 5,391,060, the disclosures of which are incorporated herein by reference. The useful life of a diaphragm is limited, however, such that under conditions of wear the diaphragm will slowly lose its elasticity and eventually rupture. Because the motive air used to drive these pumps and the fluid being transferred are separated only by the diaphragm, failure of the diaphragm can result in the contamination and/or damage of the pump equipment by the material being pumped. When a diaphragm failure occurs, the liquid being transferred can leak through the tear and gradually fill the air side of the diaphragm. If the pump is not stopped by the operator, the fluid will eventually invade the valve mechanism of the pump. Such failures can require considerable time and expense for cleaning, repair, or both. Moreover, diaphragm failures permit chemicals being pumped to be ejected into the atmosphere via the exhaust thereby releasing them into the environment where they may result in further damage or injury.

The use of leak detection apparatus for sensing the presence of unwanted fluids in double diaphragm pumps is known in the art. An example is shown in U.S. Pat. No. 5,062,770 issued to Story et al., the disclosure of which is incorporated herein by reference. In the '770 patent, two leak trace detection probes are provided in containment chambers which are formed by spaced apart dual diaphragm pumping components.

ARO® Fluid Products, a wholly owned subsidiary of Ingersoll-Rand Company, also presently manufactures large diaphragm pumps equipped with leak detection sensors in the air chambers of the pump that give an output signal when a fluid is present in the air chamber. Shown in FIG. 1 is an ARO® double diaphragm pump 52 having two pumping cavities formed between an air cap 54 and a fluid cap 56. The pumps provided with these leak detection sensors are larger size pumps, i.e., those having inlet and outlet National Pipe Thread (NPT) sizes of one inch or greater. Because of their larger size and shape, these large pumps permit the insertion of a sensor 40 through the air cap 54 and directly into each air chamber. Thus, for a double diaphragm pump, two sensors are used to detect leaks in the pump. Because the cost of the sensors is relatively low compared with the overall cost of the pump, the use of multiple sensors is not cost prohibitive.

Pumps having inlet and outlet thread sizes that are smaller than 1" NPT, however, typically do not provide the geometry or space required to readily accommodate the insertion of sensors in the air caps as described above. Additionally, because the cost of smaller pumps (i.e., pumps having inlet and outlet thread sizes less than one inch) is proportionally less than for larger pumps (i.e., pumps having inlet and outlet thread sizes of one inch or greater) and, typically, is less than the cost of two sensors, the use of multiple leak detection sensors in smaller diaphragm pumps is generally cost prohibitive. Although smaller pumps suffer from the same diaphragm failure problems as larger pumps, diaphragm failure detection sensors have not been readily incorporated into smaller pumps for the reasons stated above.

The foregoing illustrates limitations known to exist in present diaphragm failure detection devices. Thus it is apparent that it would be advantageous to provide diaphragm failure detection devices which can reduce the number of sensors needed. Accordingly a diaphragm failure sensing apparatus and diaphragm pumps incorporating the same are provided including the features more fully disclosed hereinafter.

SUMMARY OF THE INVENTION

According to the present invention, a diaphragm failure sensing apparatus is provided for use in a diaphragm pump having at least two pumping cavities, each pumping cavity having a fluid chamber and a motive gas chamber separated by a pumping diaphragm. The diaphragm failure sensing apparatus includes a fluid conduit for connection with each of the motive gas chambers of the diaphragm pump, a sensor chamber connected to the fluid conduit, and a check valve located in the fluid conduit for alternately connecting the sensor chamber to the motive gas chambers.

Also provided is a diaphragm pump having at least two pumping cavities, each pumping cavity having a fluid chamber and a motive gas chamber separated by a pumping diaphragm. A fluid conduit is disposed between and connected individually to each of the motive gas chambers and a sensor chamber is connected to the fluid conduit which is alternately connected to the motive gas chambers by a check valve located in the fluid conduit.

The foregoing and other aspects will become apparent from the following detailed description of the invention when considered in conjunction with accompanying drawing figures.

BRIEF DESCRIPTION OF THE DRAWING FIGURES

DETAILED DESCRIPTION OF THE PREFERRED EMBODIMENTS

Figure 1:
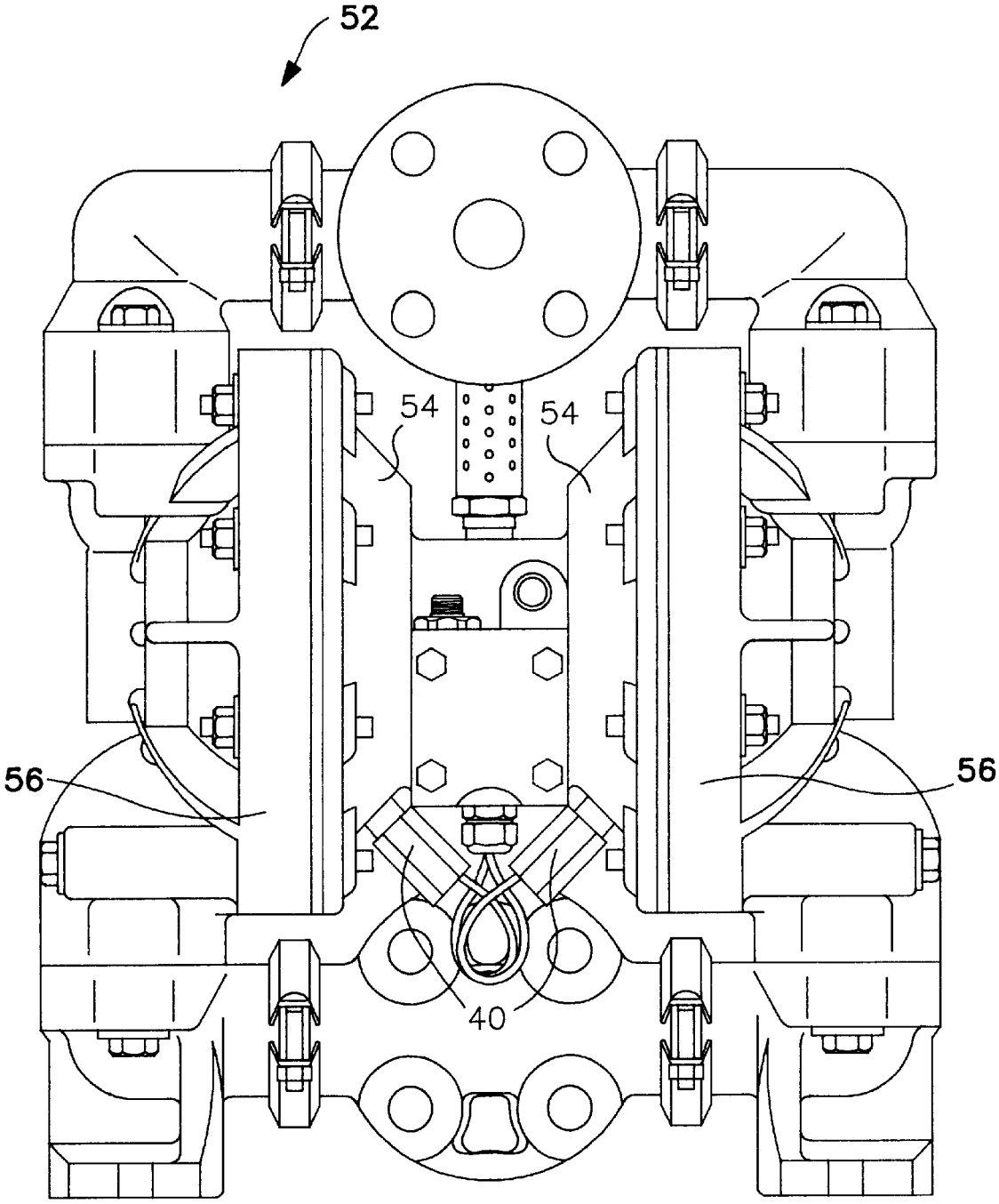
FIG. 1 PRIOR ART
FIG. 1 is an isometric view of a conventional diaphragm pump having leak detection sensors disposed in the air chambers of the pump.

As used herein, the term "diaphragm" means a flexible barrier that divides chambers or compartments. Typically, such barriers are useful with diaphragm pumps, however, these diaphragms may also be employed as a barrier layer between two compartments in any application where a fluid exists in one compartment and would cause deleterious effects if present in the other compartment.

The invention is best understood by reference to the accompanying drawings in which like reference numbers refer to like parts. It is emphasized that, according to common practice, the various dimensions of the diaphragms and the associated pump parts as shown in the drawings are not to scale and have been enlarged for clarity.

Figure 2:
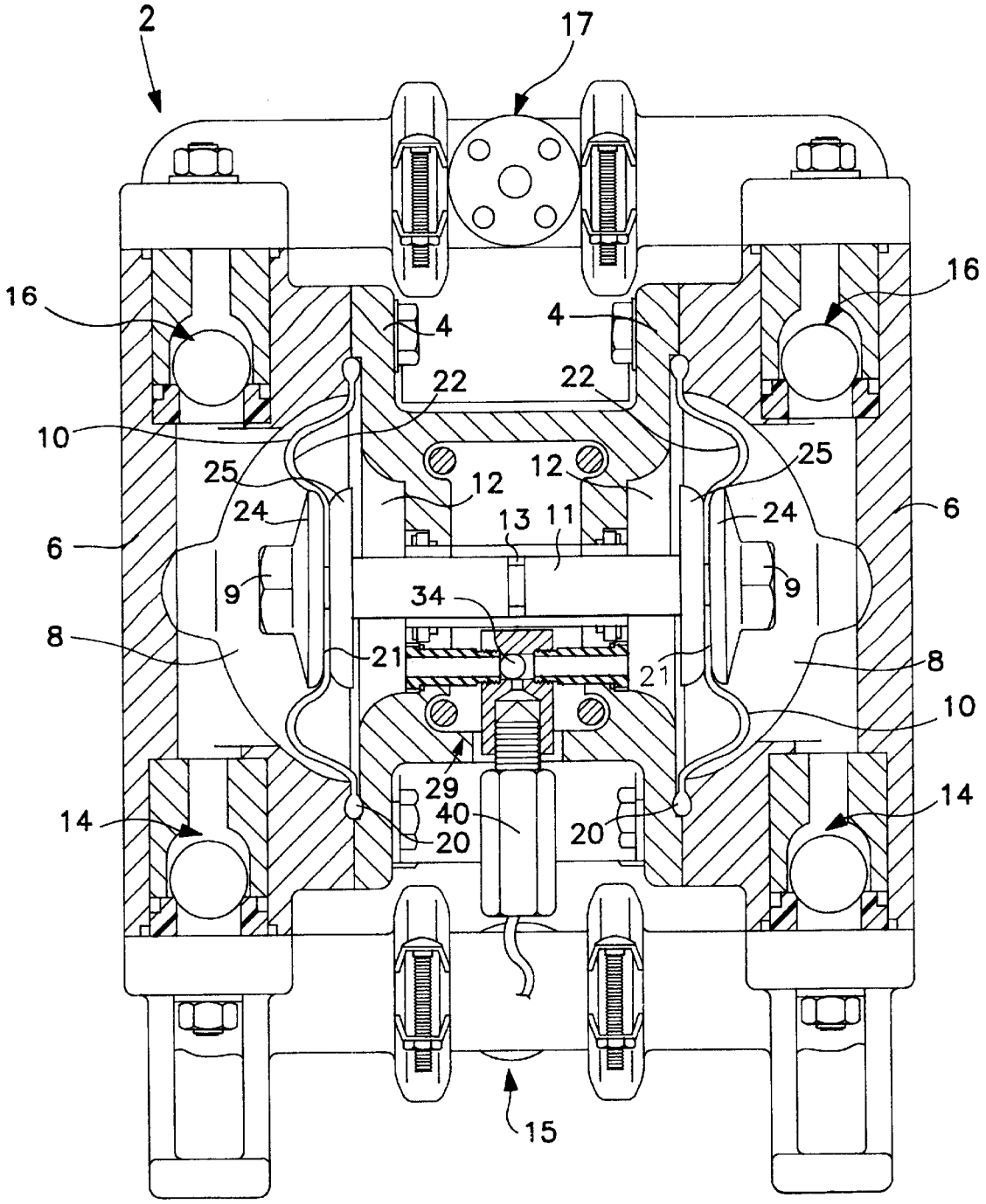
FIG. 2 is a partial sectional view of a diaphragm pump having a diaphragm failure sensing apparatus according to the present invention.

Referring now to the drawings, shown in FIG. 2 is a double diaphragm pump 2 according to the present invention having two pumping cavities formed between an air cap 4 and a fluid cap 6. Each cavity includes a fluid chamber 8 and an air chamber 12 which are separated by a pumping diaphragm 10 spanning the width of the cavity with the diaphragms being interconnected by a connecting rod 11. An O-ring 13 disposed on connecting rod 11 seals each air chamber 12 from the other. Each fluid chamber 8 is connected to an intake valve 14 and exhaust valve 16, with (i) intake valve 14 connected through an intake manifold 15 to a source of fluid or other material to be pumped through the pump and (ii) the exhaust valve 16 connected to an exhaust manifold 17. By introducing pressurized air into one air cap 4, the pressure acts on the diaphragm spanning the air cap causing the diaphragm to move toward its fluid cap 6. This displaces the fluid being pumped from the fluid chamber 8 and forces it to travel out the exhaust valve 16 and exhaust manifold 17. As the diaphragm moves, it pulls connecting rod 11 which, in turn, pulls the other diaphragm away from its corresponding fluid cap and toward its corresponding air cap, thereby drawing fluid into the other fluid chamber through its intake valve and manifold 15. At the end of the stroke, the pressurized air cap is exhausted and the exhausted air cap is pressurized, reversing the motion. Thus, the double diaphragm pump accomplishes a nearly constant flow of pumping through the pump by continuously driving the connecting rod back and forth in the pump.

The critical driving element of diaphragm pump 2 is diaphragm 10 which is a generally circular membrane typically made of a relatively flexible material, e.g., rubber or a thermoplastic elastomer (TPE), and having an outer peripheral portion 20 that is clamped or otherwise held in a stationary position against the pump housing. Such diaphragms also include a centrally located portion 21 and a working portion 22 that joins the central and peripheral portions. The central portion 21 is typically clamped between a pair of rigid backup washers 24, 25 and secured by a threaded bolt 9 which passes through centrally located holes in the backup washers and the diaphragm into the ends of connecting rod 11 as shown. Rigid backup washers 24, 25 are typically metal castings that provide rigid support for diaphragms 10 during operation of diaphragm pump 2. The working and central portions of the diaphragm are displaced in a reciprocating manner as described above to drive liquid out of the pump.

Figure 3:
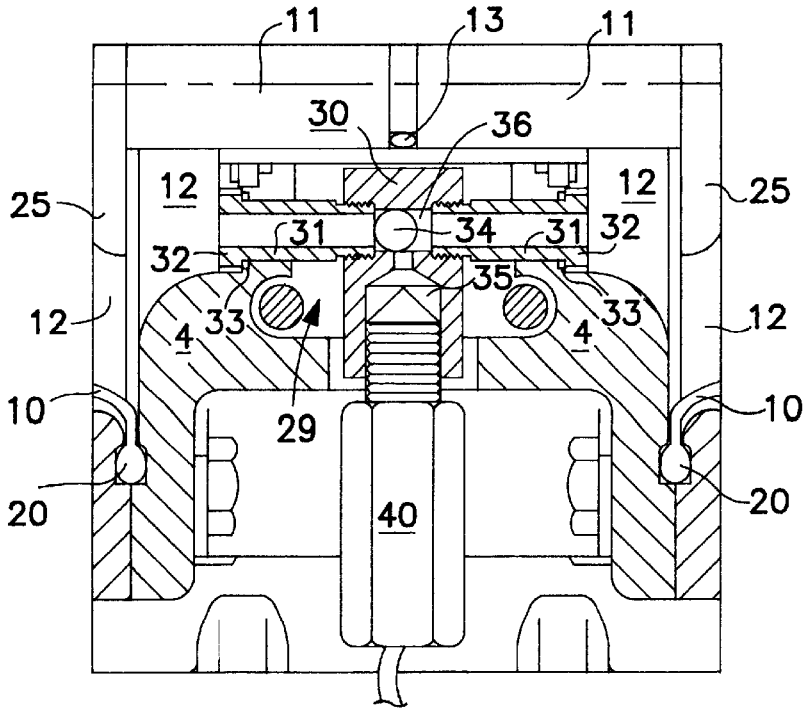
FIGS. 3 and 4 are partial sectional views of the diaphragm failure sensing apparatus according to the present invention at the beginning of moving through successive stages of a pumping stroke within the diaphragm pump shown in FIG. 2.
Figure 4:
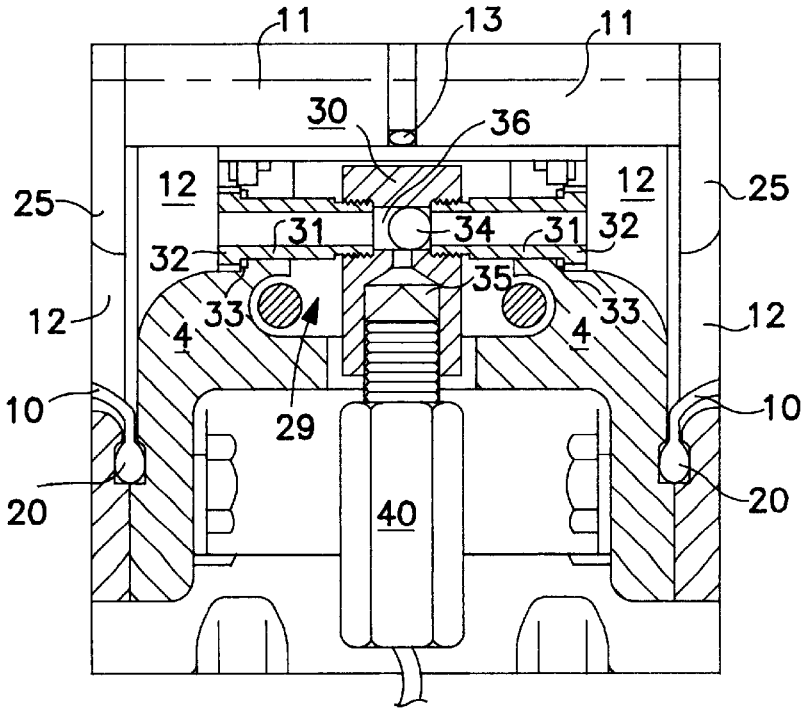

Shown in FIGS. 2–4 is a diaphragm failure sensing apparatus 29 according to the present invention which senses diaphragm failure while isolating pressure between chambers within an air operated diaphragm pump. Diaphragm failure sensing apparatus 29 includes a fluid conduit disposed between the air chambers 12 and a sensor chamber 35 which is alternately connected to the air chambers by a check valve located in the fluid conduit. The fluid conduit is preferably made up of ducts 31 which pass through bore holes in air caps 4 and are connected in line with one another to a bore 36 located in a check body 30 as shown. Preferably, ducts 31 are externally threaded and attached to check body 30 via internal threads provided in bore 36. Flanges 32 provided on ducts 31 and O-rings 33 sealingly engage each duct against the air caps 4 upon tightening the threaded portion of ducts 31 into check body 30. A check ball 34 is provided in the check body 30 between the ends of ducts 31 with the diameter of check ball 34 being provided so as to permit it to seat in and close off the ducts from the sensor chamber 35.

A sensor 40 is provided which monitors and generates a signal (e.g., a voltage pulse, a current pulse, a light pulse) which is output to a control device (not shown) when liquid is present in sensor chamber 35. Preferably, sensor 40 is an optical probe such as the GEMS® ELS-1100 Series electro-optic level switch manufactured by IMO Industries, Inc., Plainville, Conn., 06062, U.S.A. Sensor 40 is preferably threadingly engaged in sensor chamber 35 to facilitate removal and replacement therein. Preferably, sensor 40 is inserted into the check body at right angles to the ducts 31 to allowing the sensor to be positioned in the center of the pump where there is adequate space.

Preferably, the component parts of the diaphragm failure sensing apparatus 29 which are connected, namely the ducts 31, the check body 30 and sensor 40 are provided with threads as described above to facilitate assembly. Assembly consists of inserting check ball 34 into check body 30 and threading ducts 31 into check body 30, which is dryseal threaded, to trap check ball 34 in place. As described above, ducts 31 seal within air caps 4 by two O-rings 33.

Operation of the diaphragm failure sensing apparatus will now be described with reference to FIGS. 3 and 4 that illustrate the motion of diaphragms 10 as they begin to move through successive stage of a pumping stroke within the fluid chambers 8 and air chambers 12 of a diaphragm pump. Operation of the pump is as described above with respect to the diaphragm pump 2 shown in FIG. 2 and is accomplished by first introducing pressurized air to one of the diaphragms 10 causing it to exert force on the fluid chamber and expel the fluid within. This motion also causes the other diaphragm 10 attached via connecting rod 11 to draw fluid into its respective fluid chamber. When diaphragms 10 and connecting rod 11 have stopped travelling, pressurized air is then introduced to diaphragm 10 to reverse the motion. By alternating the introduction of pressurized air to diaphragms 10 in this manner, the pumping motion of the diaphragm pump is continuously repeated.

During operation of diaphragm pump 2, the check valve separates the air chambers and is actuated by the pressure differential between the air chambers thereby alternately connecting each air chamber 12 during pressurization with a sensor chamber 35. More specifically, as shown in FIG. 3, upon pressurizing the right air chamber 12, the check ball operates to seal off the left duct 31 and thereby connecting sensor chamber 35 with right air chamber 12 via right duct 31. Thus, while the right air chamber 12 is being filled, it is being monitored by sensor 40 for fluid leakage through the right diaphragm 10. In this manner if a tear is present in the diaphragm separating the air and fluid chambers, fluid leaks into the air chamber and flows through the duct to the sensor, which then signals the failure. In similar fashion, upon pressurizing the left air chamber 12 as shown in FIG. 4, the check ball is moved to seal off the right duct 31 thereby connecting sensor chamber 35 with left air chamber 12 via left duct 31 and permitting sensor 40 to monitor the left air chamber 12 for fluid leakage through left diaphragm 10. As a result of the diaphragm failure sensing apparatus of the present invention, leak failure detection can be accomplished in diaphragm pumps having multiple motive gas chambers while using only one sensor, thus providing a compact design which alleviates space configuration problems and significantly reducing cost.

While embodiments and applications of this invention have been shown and described, it will be apparent to those skilled in the art that many more modifications are possible without departing from the inventive concepts herein described. For example, although shown using a multiple piece check body and duct assembly as shown, the diaphragm failure sensing apparatus could be provided using an integral design by boring a fluid passageway between the air chambers of an air motor having a solid engine block and inserting a check valve therein.

Additionally, although shown and described above with respect to a preferred embodiment which incorporates an optical sensor in an air operated diaphragm pump, it will be readily recognized by those skilled in the art that other fluid detection means such as an electrical sensor, may be substituted therefor and used in conjunction with pumps driven by motive gases other than air such as nitrogen. Moreover, although shown as being particularly well suited for use with smaller pumps having space limitations which would preclude or make difficult the installation of a sensor through an air cap, the diaphragm failure sensing apparatus according to the present invention may be incorporated into any size pump. One of the benefits realized by using the diaphragm failure sensing apparatus of the present invention is the cost savings realized by using a single sensor rather than two or more sensors. This cost savings is further multiplied when considering that typically in maintaining pumps which use two or more sensors, if one sensor is found to have failed, the remaining sensors are also replaced as preventative maintenance because to the time required to tear apart and rebuild the pump precludes replacing each individual sensor as they fail. Thus, in the prior art many sensors were scrapped prematurely, which problem the use of a single sensor eliminates.

Additionally, although shown as a three-way valve between two motive fluid chambers and a sensor chamber, it will be readily recognized that the valve may be modified to connect multiple inlets from multiple motive gas chambers to a single sensor chamber. Thus, in this manner, pumps having multiple motive fluid chambers may be provided with leak detection using only one sensor.

It is understood, therefore, that the invention is capable of modification and therefore is not to be limited to the precise details set forth. Rather, various modifications may be made in the details within the scope and range of equivalents of the claims without departing from the spirit of the invention.

Having described the invention, what is claimed is:

1. A diaphragm failure sensing apparatus for use in a diaphragm pump having at least two pumping cavities, each pumping cavity having a fluid chamber and a motive gas chamber separated by a pumping diaphragm, said diaphragm failure sensing apparatus comprising:

a fluid conduit for connection with each of the motive gas chambers of the diaphragm pump;

a sensor chamber connected to said fluid conduit; and a check valve located in said fluid conduit for alternately connecting said sensor chamber to the motive gas chambers.

2. The diaphragm failure sensing apparatus according to claim 1 wherein said fluid conduit comprises ducts connected with one another to a bore located in a check body of said check valve.

3. The diaphragm failure sensing apparatus according to claim 2 wherein said check valve comprises a check ball in a bore of said check body, said check ball having a diameter configured to individually seat in and close off each of said ducts from said sensor chamber.

4. The diaphragm failure sensing apparatus according to claim 2 wherein said ducts are externally threaded and are attached to said check body via internal threads provided in said bore.

5. The diaphragm failure sensing apparatus according to claim 2 wherein said ducts comprise flanges and corresponding O-rings which sealingly engage each of said ducts in said diaphragm pump upon tightening said threaded portion of said ducts into said check body.

6. The diaphragm failure sensing apparatus according to claim 1 further comprising a sensor which monitors and generates a signal when liquid is present in said sensor chamber.

7. The diaphragm failure sensing apparatus according to claim 6 wherein said sensor is an optical probe level switch.

8. The diaphragm failure sensing apparatus according to claim 6 wherein said sensor is inserted into said check body at right angles to said ducts.

9. The diaphragm failure sensing apparatus according to claim 1 wherein said check valve is actuated by a pressure differential between the motive gas chambers for alternately connecting said sensor chamber to each motive gas chamber upon pressurizing.

10. A diaphragm pump comprising:

at least two pumping cavities, each pumping cavity having a fluid chamber and a motive gas chamber separated by a pumping diaphragm;

a fluid conduit disposed between and connected individually to each of said motive gas chambers; and a sensor chamber connected to said fluid conduit which is alternately connected to said motive gas chambers by a check valve located in said fluid conduit.

11. The diaphragm pump according to claim 10 wherein said motive gas of said diaphragm pump is selected from the group consisting of air and nitrogen.

12. The diaphragm failure sensing apparatus according to claim 10 wherein said fluid conduit comprises ducts connected with one another to a bore located in a check body of said check valve.

13. The diaphragm pump according to claim 10 wherein each of said pumping cavities is formed between an air cap and a fluid cap; and said fluid conduit comprises ducts passing through bore holes in each of said air caps, said ducts being connected with one another to a bore located in a check body of said check valve.

14. The diaphragm pump according to claim 12 further comprising a check ball in said bore of said check body, said check ball having a diameter configured to individually seat in and close off each of said ducts from said sensor chamber.

15. The diaphragm pump according to claim 12 wherein said ducts are externally threaded and are attached to said check body via internal threads provided in said bore.

16. The diaphragm pump according to claim 13 wherein said ducts comprise flanges and corresponding O-rings which sealingly engage each of said ducts against said air caps upon tightening said threaded portion of said ducts into said check body.

17. The diaphragm pump according to claim 10 further comprising a sensor which monitors and generates a signal when liquid is present in said sensor chamber.

18. The diaphragm pump according to claim 17 wherein said sensor is an optical probe level switch.

19. The diaphragm pump according to claim 17 wherein said sensor is inserted into said check body at right angles to said ducts.

20. The diaphragm pump according to claim 10 wherein said check valve separates said motive gas chambers and is actuated by a pressure differential between the motive gas chambers thereby alternately connecting said sensor chamber to each motive gas chamber upon pressurizing.

21. The diaphragm pump according to claim 10 wherein said fluid conduit is provided by a bore located in an engine block between said air chambers.

* * * * *